United States Patent [19]

Yamada et al.

[11] Patent Number: 4,581,309

[45] Date of Patent: Apr. 8, 1986

[54] ELECTROPHOTOGRAPHIC COLOR REPRODUCTION PROCESS

[75] Inventors: Yasuo Yamada; Harutaka Sudo, both of Ebina, Japan

[73] Assignee: Fuji Xerox Co., Ltd., Tokyo, Japan

[21] Appl. No.: 677,800

[22] Filed: Dec. 4, 1984

[30] Foreign Application Priority Data

Apr. 4, 1984 [JP] Japan ..... 59-65972

[51] Int. Cl.[4] ..... G03G 15/01

[52] U.S. Cl. ..... 430/44; 430/54

[58] Field of Search ..... 430/42, 44, 54

[56] References Cited

U.S. PATENT DOCUMENTS 3,928,033 12/1975 Anzai ..... 430/42

4,106,870 8/1978 Kondo et al. ..... 430/42

*Primary Examiner*—John L. Goodrow

*Attorney, Agent, or Firm*—Frost & Jacobs

[57] ABSTRACT

A three-color separation electrophotographic color reproduction process which includes primary uniform charge steps, color separation image exposure steps, development steps and transfer steps. The process further includes between each image exposure step and development step a uniform exposure step and a secondary charge step. The secondary charge step is carried out either by DC corona discharge of the same plurality as the primary charge step or by AC corona discharge together with DC corona discharge. The quantity of light of the uniform exposure step and the quantity of charge of the secondary charge step are controlled, to reduce stepwise, as the second and third primary color reproduction proceeds.

4 Claims, 25 Drawing Figures

ELECTROPHOTOGRAPHIC COLOR REPRODUCTION PROCESS

BACKGROUND OF THE INVENTION

This invention relates to an electrophotographic color process for producing an electrostatic latent image, and more particularly to an electrophotographic color process which can produce a color copy that is excellent in the reproduction of an image of the human skin part of the original color photograph.

With respect to the process of producing an image of objects by electrophotography, the Carlson Method is well known and comprises the charging step in which a surface of a photoconductive plate is charged uniformly, the exposure step in which the electrostatic latent image of an original is produced by exposing a photoimage of the original on the surface of the photosensitive plate, the development step in which the electrostatic latent image is developed by toner, the transfer step in which the toner image developed is transferred onto the transfer paper, and the fixing step in which the toner image transferred on the transfer paper is fixed. However, the copy produced in this way is not satisfactory in the granularity and the tone reproduction characteristics.

In Japanese patent publication No. 14526/1975, a process has been disclosed wherein the photosensitive plate comprising the conductive substrate and the photoconductive layer is charged and the electrostatic latent image is produced by the image exposure and then uniform exposure of about 2–20 Lux. sec is executed on the whole surface of the photoconductive layer. As this method can eliminate the edge effect, the image of objects produced can improve in the tone reproduction characteristics, however, its granularity becomes worse.

On the other hand, with regard to three-color separation color electrophotography, the electrostatic latent image of each color separation image is developed by the first, the second and the third developing apparatus which are arranged in such a way as to correspond to each of the three-color separation images, respectively. The light decay curves of the surface potential, in the position of each developing apparatus, of the electrostatic latent images of color separation images produced on the photosensitive plate are different with each electrostatic latent image as shown in FIG. 1. The curve means that the relation among the surface potential $V_{L1}$ of the first electrostatic latent image, the surface potential $V_{L2}$ of the second electostatic latent image, and the surface potential $V_{L3}$ of the third electrostatic latent image is represented as $V_{L1}>V_{L2}>V_{L3}$.

When the first to the third electrostatic latent images are produced on the condition that the secondary charge volume and the uniform exposure volume are constant, the obvious improvement of the the color image produced by the first electrostatic static latent image can not be recognized in granularity and color tone reproduction characteristics. The color image produced after the development of the third electrostatic latent image is good in granularity and the color tone reproduction characteristics, but not good in the detail reproduction. As shown in FIG. 2, with respect to the developing agents corresponding respectively to the electrostatic latent images, the developing property is different in magenta toner, cyan toner and yellow toner, so the color copy produced is not good in color balance.

SUMMARY OF THE INVENTION

It is therefore an object of the present invention to provide an electrophotographic color reproduction process which is capable of producing good copy quality.

Another object of the present invention is to provide an electrophotographic color reproduction process which is capable of producing a color copy with granularity, tone reproduction characteristics, detail reproduction characteristics and color balance being greatly enhanced.

In accordance with an aspect of the present invention, there is provided a three-color separation electrophotographic color reproduction process using a photoconductive plate comprising a conductive substrate and a photoconductive insulating layer mounted thereon, the process including a primary uniform charge steps on given polarity of the free surface of the photoconductive insulating layer, color separation image exposure step, development step with colored toner particles and a transfer step for transferring the developed image to an image receiving surface, wherein the above steps are repeated for the other two primary colors by using differently colored toner particles for each development, thereby forming a full color image on said image receiving surface. The process further includes the steps of: uniformly exposing said surface of the photoconductive insulating layer to light; and applying a secondary electric charge to said surface by DC corona discharge of the same polarity as the primary charge, or by AC corona discharge together with DC corona discharge of the same polarity as the primary charge, wherein the above two steps are interposed between the image exposure step, and the development step and wherein the quantity of light of the uniform exposure step and the quantity of charge of the secondary charge step are controlled for stepwise reduction as the second and third primary color reproduction proceeds.

The above and other objects, features and advantages of the present invention will become readily apparent from the following description taken in conjunction with the accompanying drawings.

DESCRIPTION OF THE PREFERRED EMBODIMENTS

Figure 3:
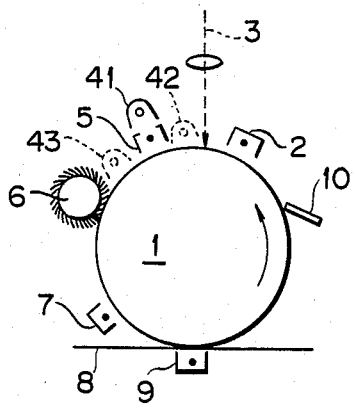
FIG. 3 is a diagrammatic representation of a copy reproduction apparatus for explaining the principle of the latent image forming process according to the present invention.

The principle of the latent image forming process according to the invention will now be described referring to FIG. 3 and FIG. 4.

Figure 4A:
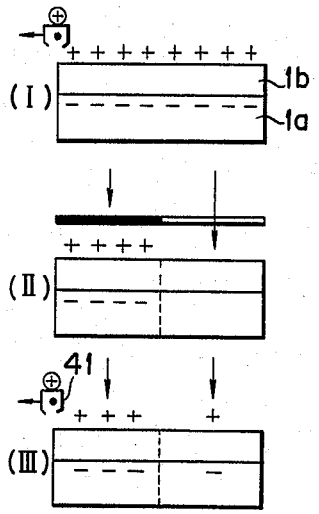
FIGS. 4A to 4C are explanatory views of the principle of the latent image forming process according to the present invention.

A photosensitive drum 1 comprises a conductive substrate 1*a* and photoconductive layer 1*b* mounted thereon. The photoconductive layer 1*b* on the surface of the photosensitive drum 1 rotating in the arrow direction is uniformly charged positive by a primary charge corotron 2 (as shown in FIG. 4A(I)), and an aerial image 3 is irradiated thereon (as shown in FIG. 4A(II)), and then uniform exposure is performed by a uniform exposurre lamp-41 and the layer is simultaneously charged positive at the secondary W charging by a secondary charge corotron 5 in a similar way to the primary charging (as shown in FIG. 4A(III)). The electrostatic latent image produced in this way on the surface of the photosensitive plate is developed by a developing apparatus 6 and the developed image is transferred by way of a pretransfer corotron 7 and a transfer corotron 9 on a transfer paper being carried to a paper conveying lane 8 and fixed, with the result that a required copy is produced. The surface of the photosensitive drum 1, after finishing the transfer is cleaned by a cleaner 10 so as to get ready for the subsequent copy process.

Figure 4B:
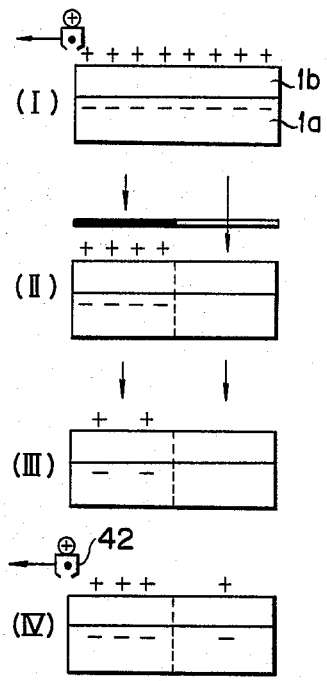
Figure 4C:
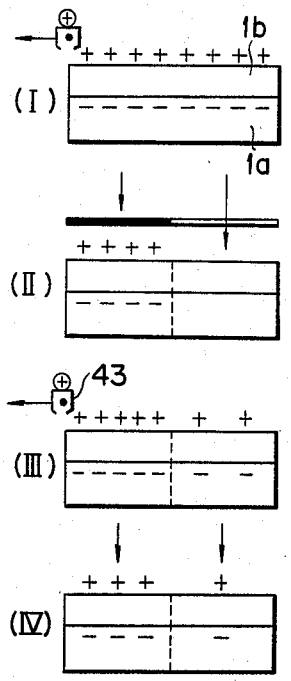

FIG. 4B shows case of the uniform exposure before the secondary charge, and the electrostatic latent image is produced on the photoconductive layer through the following process: the primary charge (FIG. 4B(I)) on the surface of the photoconductive layer of the photosensitive plate, and the image exposure (FIG. 4B(II)), and uniform exposure (FIG. 4B(III)), and the secondary charge (FIG. 4B(IV)), in this order. FIG. 4C shows the case of the uniform exposure after the secondary charge, and the electrostatic latent image is produced on the photoconductive layer through the following process: the primary charge (FIG. 4C(I)) on the surface of the photoconductive layer of the photosensitive plate, and the image exposure (FIG. 4C(II), and uniform exposure (FIG. 4C(III)) and the secondary charge (FIG. 4C(IV)), in this order. From the electrostatic latent image produced in this way, the required copy is produced through the development step, the transfer step and the fixing step.

Figure 5A:
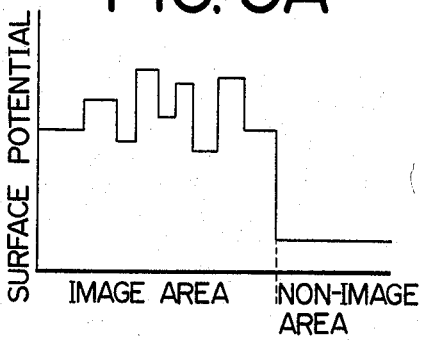
FIGS. 5A and 5B are graphs showing, respectively, the potential patterns and the electric field patterns formed on the photosensitive plate surface by a conventional method.
Figure 5C:
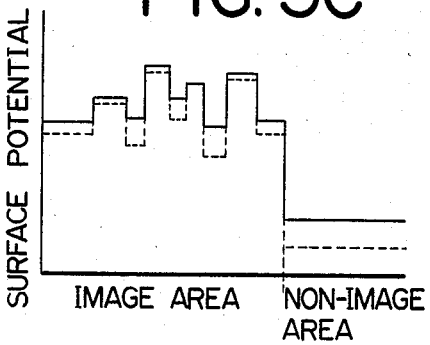
FIGS. 5C and 5D are graphs showing, respectively, the potential patterns and the electric field patterns according to the present invention.
Figure 5B:
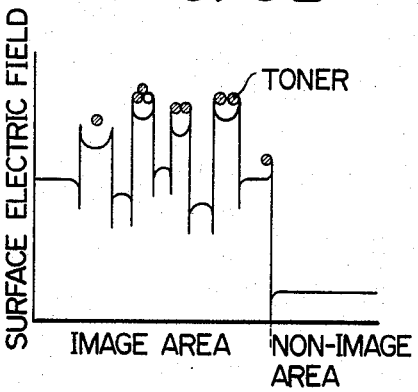
Figure 5D:
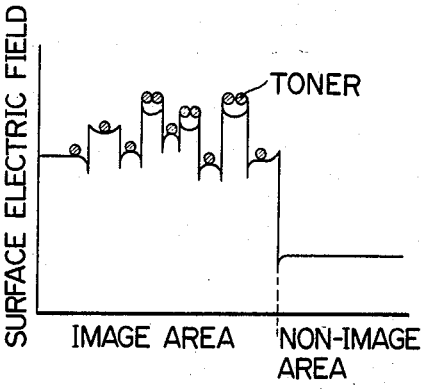

The potential patterns and the electric field patterns being formed on the photosensitive plate surface, in combination with the uniform exposure and the secondary charge by the present invention's method, and the potential patterns and the electric field patterns being formed on the photosensitive plate surface by the conventional Carlson Method, are shown diagramatically in FIGS. 5A to 5D. FIG. 5A and FIG. 5B show the potential patterns and the electric field patterns formed on the photosensitive plate surface by the Carlson Method or the Canon N. P. Method, and FIG. 5C and FIG. 5D show each of the patterns in combination with the uniform exposure and the secondary charge by the present invention's method. The broken line patterns in FIG. 5C correspond to the solid line in FIG. 5A. FIG. 5C clearly shows the improvement by the present invention's method in tone reproduction characteristics of the image ranging from the image section to non-image section.

Figure 6:
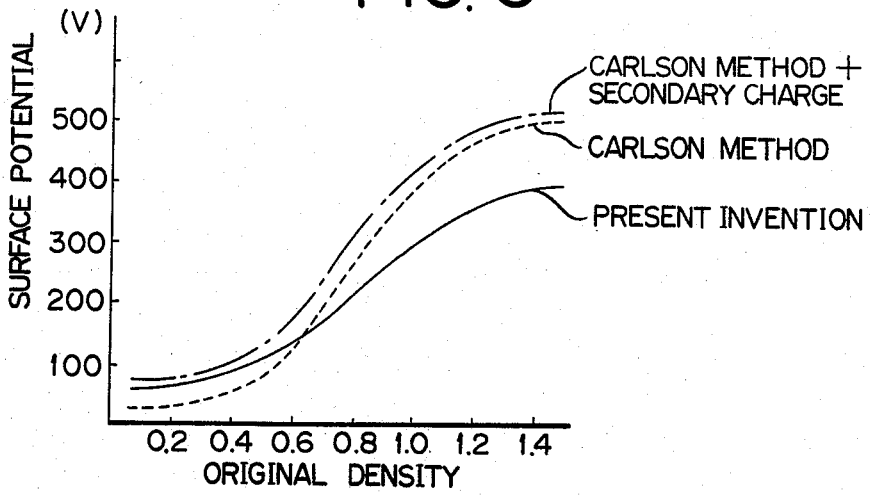
FIG. 6 is a graph showing the light decay curves of the electrostatic latent images formed on the photosensitive plate by the Carlson method, by the Carlson method with the secondary charge step added, and by the method of the present invention.

In the comparison of FIG. 5B with FIG. 5D, the electric field patterns made by this invention's method are more uniform in the toner distribution than those by the conventional method, with the result that the copy possesses excellent granularity. FIG. 6 shows the light decay curves of the electrostatic latent image formed on the same photosensitive plate by the Carlson Method or by a version of the Carlson Method with the secondary charge step added, and by the present invention's method respectively. FIG. 6 shows that the decay curve of the present invention improves in linearity, with the result that the copy produced improves in tone reproduction characteristics.

Regarding the light source used for the uniform exposure in the present invention's method, an ordinary fluorescent lamp and a linear halogen lamp are available, and regarding the charging device used for the secondary charge, an ordinary corotron or a scorotron charging device is available. With respect to the amount of the uniform exposure, if the intensity of illumination on the photosensitive plate surface by the uniform exposure is not less than that on the background of the original at the time when the image is exposed, the electrostatic latent image vanishes. The example of the secondary charging device available in the present invention's method is shown in FIGS. 7A to 7H. In FIGS. 7A to 7H, reference numeral 51 designates a corotron wire, numeral 52 designates a corotron shield, numeral 53 designates a screen grid, and in this invention these secondary charging devices are adequately in combination with the uniform exposure lamp.

Figures 7A, 7B, 7C, 7D:
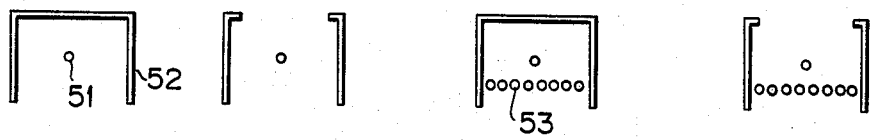
FIGS. 7A to 7H are schematic representations of charge devices which can be employed in the secondary charging step of the present invention.
Figures 7E, 7F, 7G, 7H:
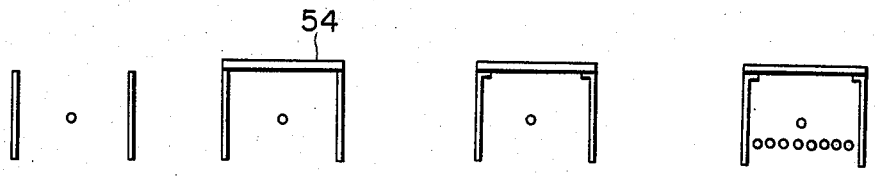
Figure 8:
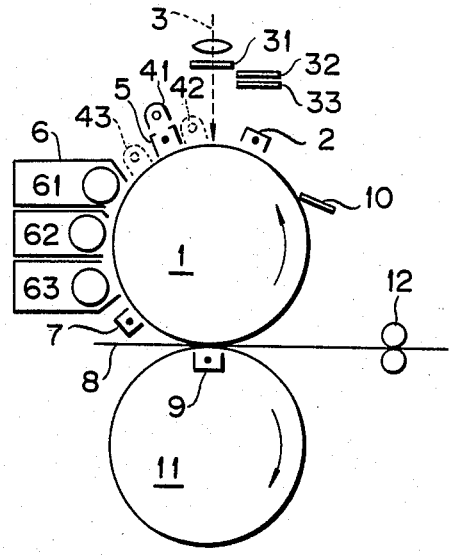
FIG. 8 is a schematic view of a color copying machine which is adapted to perform the process of the present invention.

With respect to the uniform exposure step and the secondary charge step occurring between the color separation image exposure step and the development step, the uniform exposure lamps 41, 42, 43 can be arranged before the secondary charging device 5 (in the case of 42), or after the device 5 (in the case of 43), or together with the device 5 ( in the case of 41) as shown in FIG. 8. Regarding the secondary charging device used in combination with the uniform exposure lamp 41, the types shown in FIGS. 7B, 7D and 7E are suitable, and regarding the secondary charging device used in combination with the uniform exposure lamp 42 or 43, the types shown in FIGS. 7A, 7C, 7F, 7G and 7H are preferable.

The secondary charging in the present invention's method is done by a DC power source or and the AC power source with DC superposition. With respect to the light amount of the uniform exposure and the amount of the secondary charge, it is required that they are controlled so as to decrease stepwise according to, e.g., the falling of the surface potential in the dark section in producing the second electrostatic latent image and the third electrostatic latent image. That is, the light amount of the uniform exposure and the amount of the secondary charge in producing the second electrostatic latent image are controlled so as to become less than those required in producing the first electrostatic latent image, and the light amount of the uniform exposure and the amount of the secondary charge in producing the third electrostatic latent image is controlled so as to become less than those required in producing the second electrostatic latent image, with the result that the color copy can be produced which is excellent in granulality, superior in the tone reproduction characteristics and the detail reproduction characteristics, and good in color balance. The light amount decrease of the uniform exposure and the amount of decrease of the secondary charge can be determined experimentally according to the surface potential of each electrostatic latent image and the reproduction property of each color toner.

Figure 9:
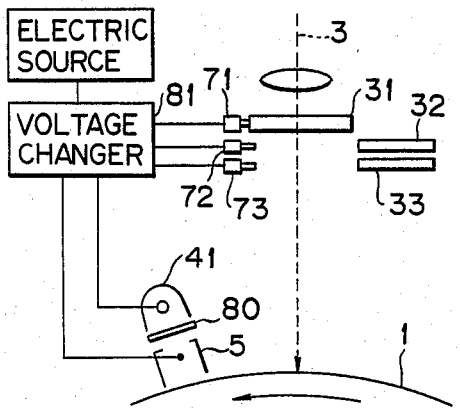
FIG. 9 is a schematic representation of a system for controlling the amount of light of the uniform exposure and the amount of the secondary charge.

FIG. 9 shows an embodiment of the system for controlling the light amount of the uniform exposure and the amount of the secondary charge. When a microswitch 71 is turned on by a blue filter 31, the impressed voltage of the secondary charging device and the impressed voltage of the uniform exposure lamp for the first latent image are impressed on the secondary charge corotron 5 and the uniform exposure lamp 41 through an impressed voltage changing circuit 81. 25 In the same way, the voltage changing circuit 81 works with the result that when a microswitch 72 is turned on by a green filter 32, the secondary charge corotron impressed voltage and the uniform exposure lamp impressed voltage for the second latent image are impressed on the secondary corotron 5 and the uniform exposure lamp 41. When a microswitch 73 is turned on by a red filter 33, the secondary charge corotron impressed voltage and the uniform exposure lamp impressed voltage for the third latent image are impressed on the secondary charge corotron 5 and the uniform exposure lamp 41.

Figure 10:
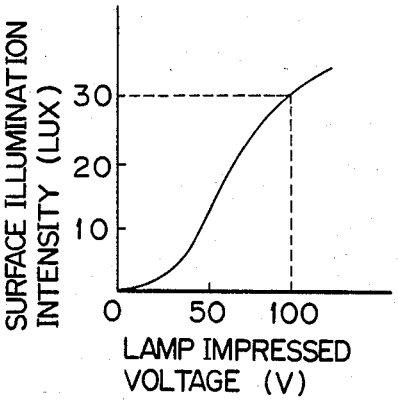
FIG. 10 is a graph showing the relation between the lamp impressed voltage and the intensity of illumination on the photosensitive plate.

A neutral density filter 80 is installed between the uniform exposure lamp 41 and the photosensitive drum 1. The relation between the lamp impressed voltage and the intensity of illumination on the photosensitive drum is shown in FIG. 10. According to this relation the intensity of illumination can be adjusted adequately by controlling the lamp impressed voltage.

The present invention will now be described more specifically by way of the following examples.

EXAMPLE 1

The present invention method was effected using the equipment shown in FIG. 8, which has a photosensitive drum 1 provided on its surface with a photosensitive plate comprising a conductive substrate and a photoconductive layer. The first electrostatic latent images produced on the photosensitive drum through the blue filter 31 were charged secondarily by the secondary charge corotron 5, and after being exposed uniformly by the uniform exposure lamp 43, they were developed by the first developing apparatus 61 with the yellow toner in it, and then they were transferred on the copy paper being set on the transfer drum 11. In the same way, through the green filter 32 the second electrostatic latent images were produced on the photosensitive drum and after being charged secondarily, and being exposed uniformly, they were developed by the second developing apparatus 62 with the magenta toner in it, and then the produced magenta toner images were transferred over the yellow toner images on the copy paper. Finally, through the red filter 33 the third electrostatic latent images were produced on the photosensitive drum and after being charged secondarily and exposed uniformly, they were developed by the third developing apparatus 63 with the cyan toner in it, and then the produced cyan toner images were transferred over the magenta toner images on the copy paper, and then the copy paper was taken off the transfer drum and placed into the fixing device 12 to fix the toner images with the result that the full color copy was produced. The conditions of the secondary charge and the uniform exposure in producing each electrostatic latent images were as follows:

TABLE I

| | first electrostatic latent image | second electrostatic latent image | third electrostatic latent image |
|---|---|---|---|
| conditions of secondary charge | | | |
| corotron wire impressed voltage ($V_W$) | +1.55 kV(D.C.) + 3.2 kV(A.C.) 400 Hz | +1.5 kV(D.C.) + 3.0 kV(A.C.) 400 Hz | +1.45 kV(D.C.) + 2.8 kV(A.C.) 400 Hz |
| conditions of uniform exposure | | | |
| intensity of illumination on plate surface | 20 lux · sec | 8 lux · sec | no exposure |

EXAMPLE 2

The color copy was produced in the same way as the Example 1, except that the secondary charge is executed by the scorotron (the screen grid corotron) with the following conditions:

TABLE II

| | first electrostatic latent image | second electrostatic latent image | third electrostatic latent image |
|---|---|---|---|
| conditions of secondary charge | | | |
| corotron wire impressed voltage ($V_W$) | +4.5 kV(D.C.) | +4.0 kV(D.C.) | +3.5 kV(D.C.) |
| screen grid impressed voltage ($V_G$) | +450 V(D.C.) | +400 V(D.C.) | +350 V(D.C.) |

Figure 11:
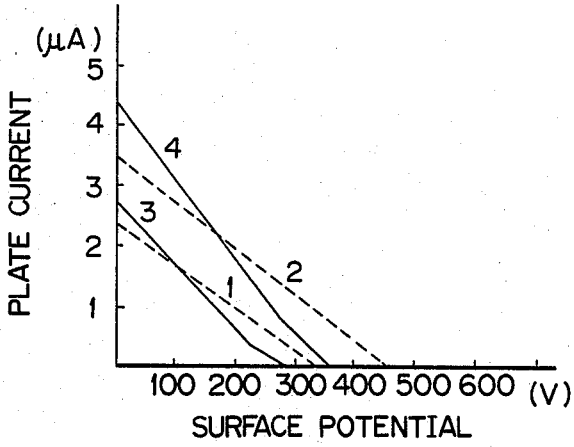
FIG. 11 is a graph showing the discharge characteristics of the corotron for the secondary charge in Example 1 and that of the scorotron used in Example 2.

FIG. 11 shows the discharge characteristics of the corotron for the secondary charge in the Example 1 (broken line 1 : $V_W$=1.5 kV(D.C.)+2.8kV(A.C.), 400 Hz broken line 2 $V_W$=1.5kV(D.C.)+3.0k V(A.C.), 400 Hz) and the discharge characteristics of the scorotron for the secondary charge in the Example 2 (solid line 3 : $V_W$=3.5kV(D.C.), $V_G$=400V(D.C.)) ; solid line 4 : $V_W$=4kV(D.C.), $V_G$=400V(D.C.)).

The result obtained from the comparison of the quality of the color copy (a) produced in the Examples 1 and 2 with that of the color copy (b) produced according to the conventional Carlson process, and the color copy (c) produced on the conditions that the secondary charge (+1.55kV(D.C.), 3.2kV(A.C.), 400Hz) and the uniform exposure (8 lux·.sec) in the first to third electrostatic latent image production steps are constant except that the other conditions are the same as in the Examples 1 and 2, is shown in the following table. The color copies produced in the Example 1 and Example 2 are scarcely different from each other in quality.

TABLE III

| | color copy (a) | color copy (b) | color copy (c) |
|---|---|---|---|
| granularity[1] | 2 | 5 | 3 |
| detail reproduction[2] | 2 | 1 | 4 |
| tone reproduction characteristics[3] | 1.0 | 0.6 | 0.9 |
| color balance[4] | 2 | 5 | 3 |

[1]granularity: grading by five steps 1-5; (1: excellent, 5: worst)
[2]detail reproduction: grading by five steps 1-5; (1: excellent, 5: worst)
[3]tone reproduction characteristics: measured by dynamic range
[4]color balance: grading by five steps 1-5; (1: excellent, 5: worst)

The above table III shows that the color copy produced by the process of the present invention is an obvious improvement comparison with the copy produced by the conventional Carlson process or the process not based on the conditions of the secondary charge and the uniform exposure indicated by the present invention.

Figure 1:
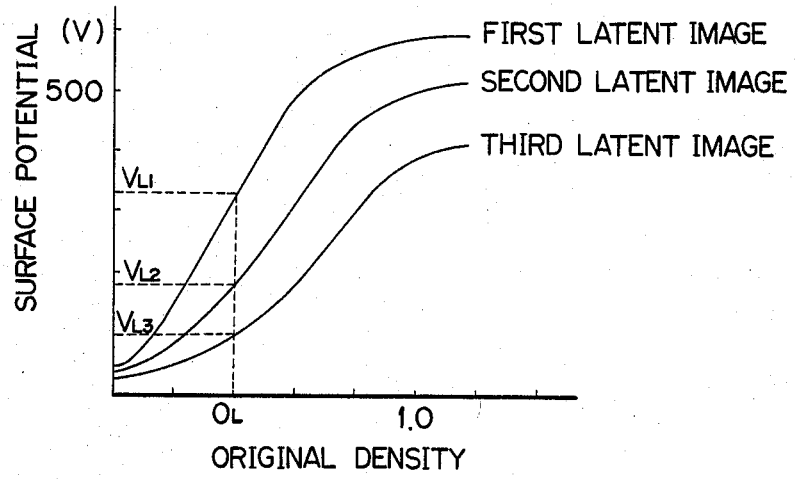
FIG. 1 is a graph showing the light decay attenuation curves of the surface potential, in the position of each developing apparatus, of the first to third electrostatic latent images.
Figure 2:
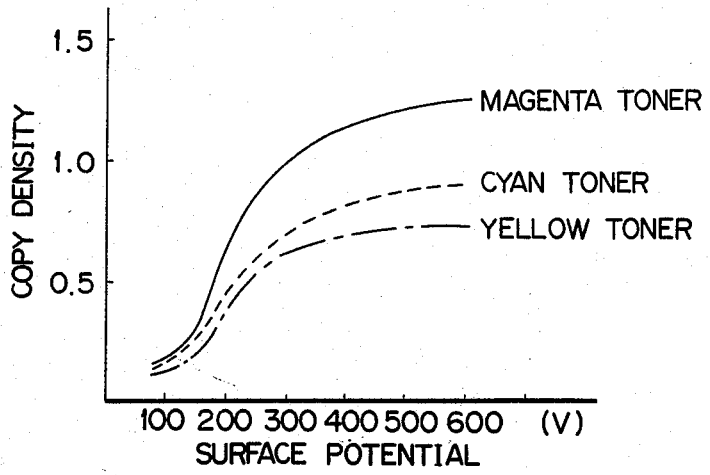
FIG. 2 is a graph showing the ideal developing property curves of color toner particles.
Figure 12:
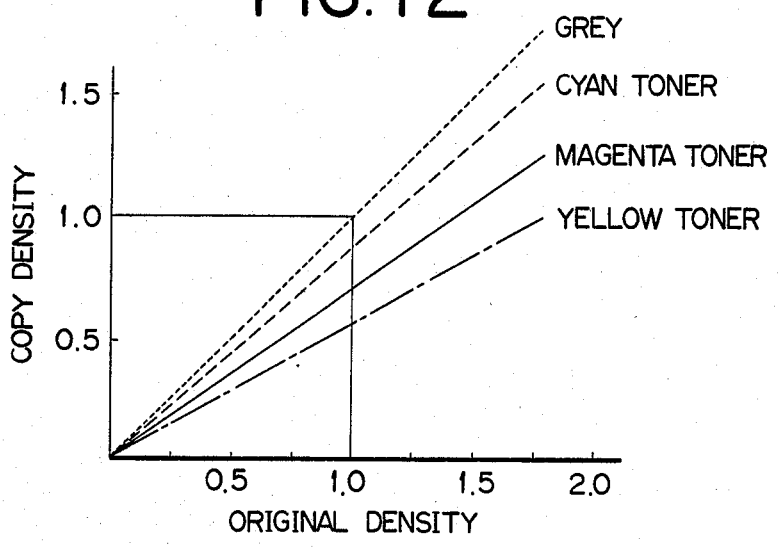
FIG. 12 is a graph showing the ideal development curves of each color toner.
Figure 13:
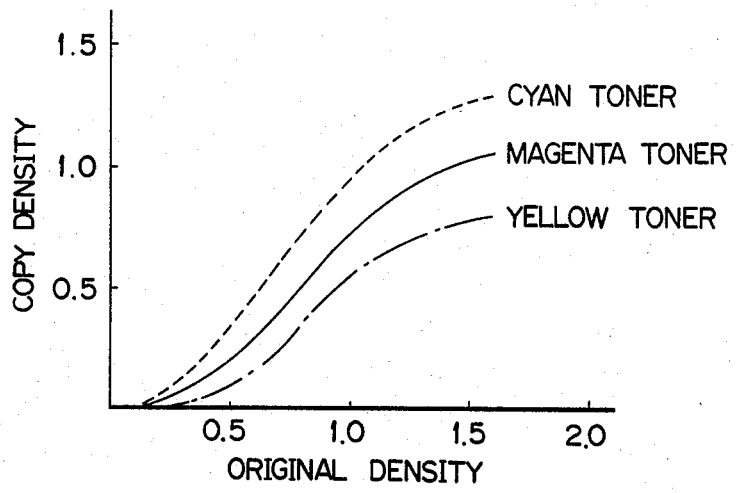
FIG. 13 is a graph showing the development curves of color toners obtained in the present invention.

FIG. 12 is a graph showing the ideal development curves of each color toner so that the excellent neutral gray image can be reproduced by superposing the cyan toner image, the magenta toner image and yellow toner image respectively on each other. FIG. 13 is a graph showing the development curves of color toner obtained by the present invention, and when compared with the color toner development curves in FIG. 2, the color toner development curves of the present invention are obviously near the ideal curves in FIG. 12.

According to the present invention, in three-color separation color electrophotography which has the steps of the primary charge, color separation image exposure, development and, if necessary, transfer, both the uniform exposure step and the secondary charge step with the same polarity as the primary charge, are inserted between the color separation image exposure step and the development step so that the secondary charge is varied according to the surface potential of the electrostatic latent image of each color separation image. Thus, the degree of the improvement in granularity of each color toner image is made constant with the result that the detailed reproduction of the produced copy improves.

The tone reproduction characteristics is improved by varying the light amount of the uniform exposure according to the surface potential of each electrostatic latent image and the development characteristics of each color toner. Thus, the color balance of the produced copy improves, with the result that excellent reproduction of the color photo original, especially the image of the human skin part, can be attained.

While the invention has been described and shown with particular reference to the preferred embodiments, it will be apparent that variations might be possible that would fall within the scope of the present invention which is not intended to be limited except as defined by the following claims.

What is claimed is:

1. In a three-color separation electrophotographic color reproduction process using a photoconductive plate comprising a conductive substrate and a photoconductive insulating layer mounted thereon, the process including a primary uniform charge step of given polarity of the free surface of the photoconductive insulating layer, color separation image exposure step, development step with colored toner particles and transfer step for transferring the developed image to an image receiving surface wherein the above steps are repeated for the other two primary colors by using differently colored toner particles for each development thereby forming a full color image on said image receiving surface, the improvement comprising the steps of:

uniformly exposing said surface of the photoconductive insulating layer to light; and applying a secondary electric charge to said surface by DC corona discharge of the same polarity as the primary charge or by AC corona discharge together with DC corona discharge of the same polarity as the primary charge wherein the uniform exposure step and the secondary charge step are interposed between the image exposure step and the development step and wherein the quantity of light of the uniform exposure step and the quantity of charge of the secondary charge step are controlled to decrease stepwise as the second and third primary color reproduction proceeds.

2. The color reproduction process as recited in claim 1, whrein the quantity of light of the uniform exposure step is so controlled that illuminance of the uniform exposure at the surface of the photoconductive insulating layer is less than that of background of an original color document to be reproduced.

3. The color reproduction process as recited in claim 1 wherein the secondary charge step and the uniform exposure step are carried out simultaneously.

4. The color reproduction process as recited in claim 1 wherein the secondary charge step and the uniform exposure step are carried out sequentially.

* * * * *